United States Patent [19]

Duke

[11] 4,170,005

[45] Oct. 2, 1979

[54] SWITCH OPERATED ALARM CIRCUIT

[76] Inventor: Norman G. Duke, 53 Tordale Crescent, Scarborough, Ontario, Canada, M1P 3X6

[21] Appl. No.: 861,724

[22] Filed: Dec. 19, 1977

[51] Int. Cl.[2] ..... G08B 13/08; G08B 29/00

[52] U.S. Cl. ..... 340/547; 335/206; 340/545

[58] Field of Search ..... 340/545, 547; 335/206

[56] References Cited

U.S. PATENT DOCUMENTS

| | | | |
|---|---|---|---|
| 2,877,361 | 3/1959 | Chase | 340/547 |
| 2,912,540 | 11/1959 | Sawicki | 340/547 |

*Primary Examiner*—Glen R. Swann, III

*Attorney, Agent, or Firm*—Fetherstonhaugh & Co.

[57] ABSTRACT

A burglar alarm that has a series of switches located close to each other and that are responsive to the application of a magnetic field. One of the switches terminates current flow to a sentinel current device while the others initiate current flow to the sentinel current device. The sentinel current device operates to supply voltage for an alarm circuit when it conducts only. Thus, in order to render the device ineffective, one must know how to apply a magnetic field to the terminating switch only without activating any of the switches that initiate current flow. The switches are all located close together so that special knowledge is required to cut off supply voltage to the alarm circuit.

9 Claims, 6 Drawing Figures

SWITCH OPERATED ALARM CIRCUIT

BACKGROUND AND BRIEF SUMMARY OF INVENTION

This invention relates to an alarm system suitable for a burglar alarm to be applied to a door, window or the like.

Alarms adapted to sense the opening of a door, window or the like are very common. The alarm of the present invention is thought to be unique and specially suited for use on a door where it is desired to cause an alarm to be given when the door is opened by an unauthorized person. It makes use of a series of switches that are operated by the manual manipulation of a magnet whereby to create magnetic fields in locations predetermined with respect to switches to operate or control the operation of the alarm.

An alarm adapted to sense the unauthorized opening of a door of the like comprises an alarm responsive to electricity current flow, an alarm current flow control device for controlling current flow to said alarm, said alarm current flow control device being nonconducting when operating potential is applied to the input thereof under normal conditions, first enabling means responsive to the opening of a door or the like to enable said alarm current flow control device to conduct and sound said alarm when an operating potential is applied to the input thereof, a sentinel current admitting device for admitting current to a sentinel circuit and thereby applying an operating potential to the input of said alarm current flow control device, said sentinel current admitting device being normally non-conductive when a voltage is applied thereto, second enabling means operable to enable said sentinel current admitting device to conduct, switch means for terminating current flow through said sentinel current admitting device to terminate conduction therethrough, said second enabling means including a plurality of switches operable by the application of an energy field, said switch means for terminating current supply being operable by the application of an energy field and being in close proximity to said plurality of switches operable by the application of an energy field of said second enabling means.

The invention will be clearly understood after reference to the following detailed specification read in conjunction with the drawings.

BRIEF DESCRIPTION OF THE DRAWINGS

FIG. 1 of the drawings is a circuit drawing of an alarm. It employs two flow control devices 10 and 12 which respond to switch means 14, 16, 18 and 20 to control electricity flow in the circuit to operate the horn alarm 22 when a door to which the alarm circuit is connected is opened by an unauthorized person. The sounding of the alarm as the door is opened can be avoided by an authorized person with knowledge to operate the switches to prevent horn operation.

Figure 1:
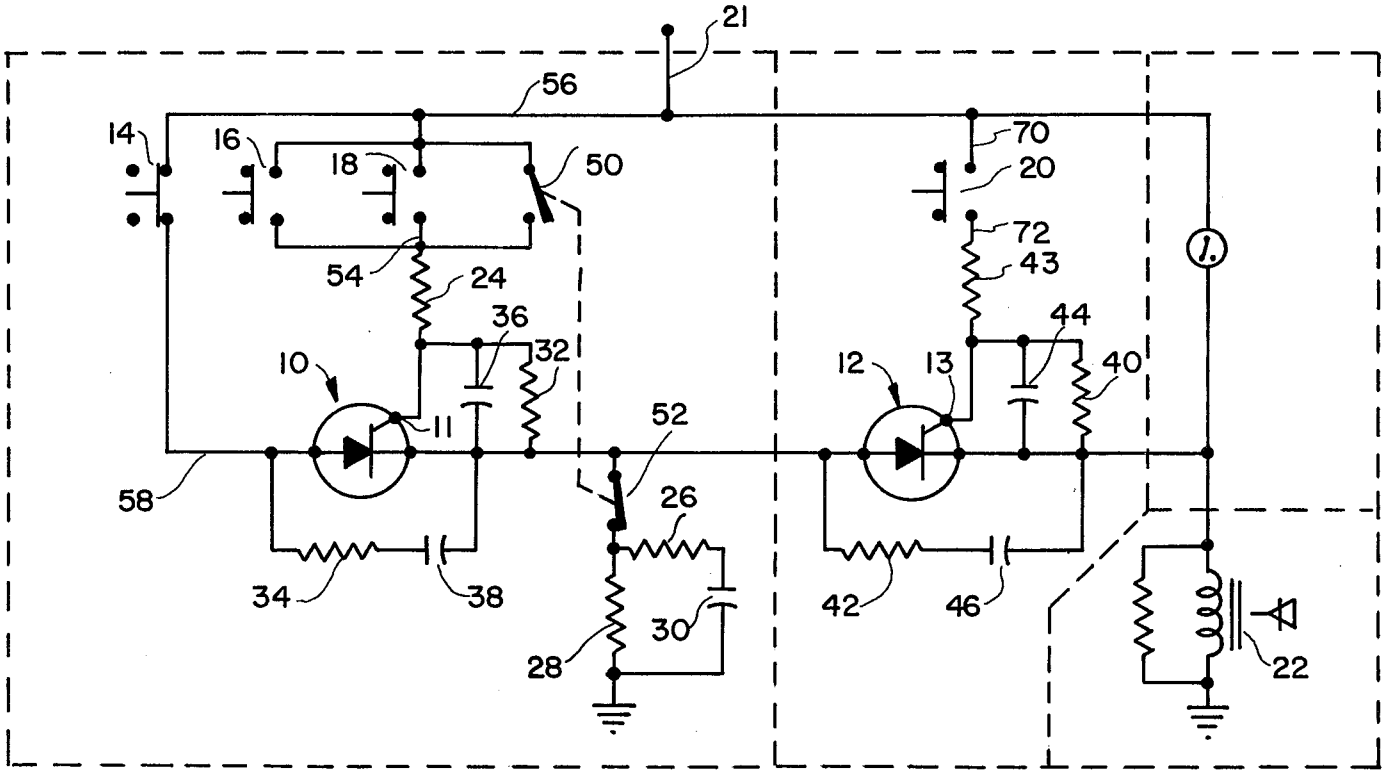
FIG. 1 is an illustration of a circuit drive diagram of an embodiment of the invention.

Sentinel current flow control device 10 controls the flow of current to a sentinel circuit and is a silicon controlled rectifier having its input normally connected to a 20 volt D.C. supply 21 through reed switch 14 and its gate connectible to the supply through bias resistor 24 and reed switches 16 or 18.

DETAILED DESCRIPTION OF INVENTION

Reed switch 14 is normally urged to a closed position and reed switches 16 and 18 are normally urged to an open position. They are each responsive to the field of a manually held bar magnet to move from their normal position but each return to their normal position upon removal of the magnetic field. Thus, switch 14 moves to an open position in the proximity of a bar magnet and switches 16 and 18 move to a closed position in the proximity of a bar magnet.

Resistors 26 and 28 and condenser 30 make up a high resistance sentinel circuit for current flow through flow control device 10 and, under normal conditions of current flow through device 10, the current in the sentinel circuit is in the order of twenty micro amperes.

Silicon controlled rectifier 10 in the circuit illustrated is manufactured by the General Electric Company as No. C106.

The output of current flow control device 10 connects with the input of a current flow control device 12 in the alarm circuit. It also is a silicon controlled rectifier of the type distributed by General Electric Company as C106.

Alarm current flow control device 12 is also normally non-conducting but its input has an operating voltage applied thereto when current flows in the sentinel circuit and it can be rendered conducting by connecting its gate to voltage source 21. This occurs when switch device 20 is closed and results in an operating current flow through the horn circuit 22 to sound an alarm.

Resistors 24, 32 and 34 and condensers 36 and 38 in the case of silicon controlled rectifier 10 and resistors 40, 42 and 43 and condensers 44 and 46 in the case of silicon controlled rectifier 12 are for the purpose of properly biasing and protecting their respective devices.

Numerals 50 and 52 represent opposed arms of a double pole double throw switch connected in the circuit such that when the switch is in one closed position arm 52 closes a circuit and arm 50 does not close a circuit as schematically shown in FIG. 1. When the switch is moved to its other closed position arm 50 closes its respective circuit and arm 52 opens its respective circuit. The arrangement makes use of only one arm of the switch at a time.

Figure 3:
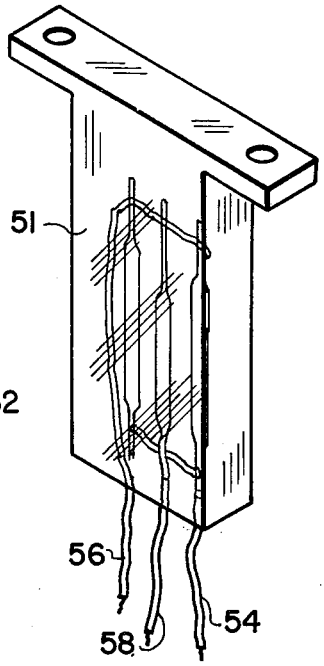
FIG. 3 is a view of the switch means for the sentinel current admitting device.

Switch devices 14, 16 and 18 are commercially available reed switches and they are potted in a plastic block 51 illustrated in FIG. 3, with lead wires 54, 56 and 58 the equivalents of which are identified by similar numbers on the circuit diagram of FIG. 1. The plastic block in use is mounted in a cavity 60 of a door 62 that extends from the upper edge of the door and is located between the two panels thereof.

The switch whose arms are indicated by numerals 50 and 52 of the circuit diagram FIG. 1 is mounted in a box 64 on the inside of the door with a handle 66 extending therefrom which is capable of moving the double throw switch to either of its two positions. Box 64 also contains the horn 22, the circuit and a battery that provides the voltage source 21.

Figure 2:
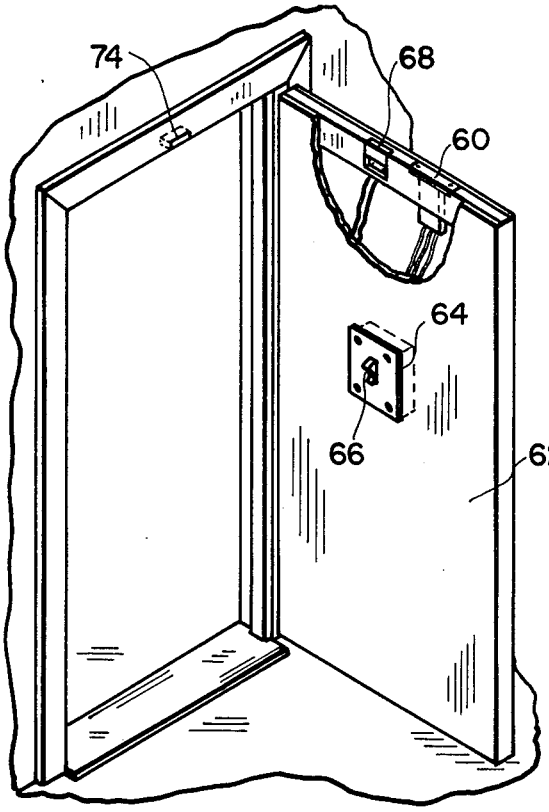
FIG. 2 is a perspective illustration illustrating how the device is mounted on a door.
Figure 5:
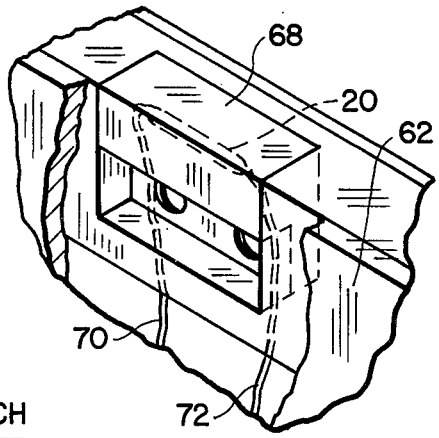
FIG. 5 is a view illustrating the manner in which the switch means for the alarm current flow control device is mounted.
Figure 6:
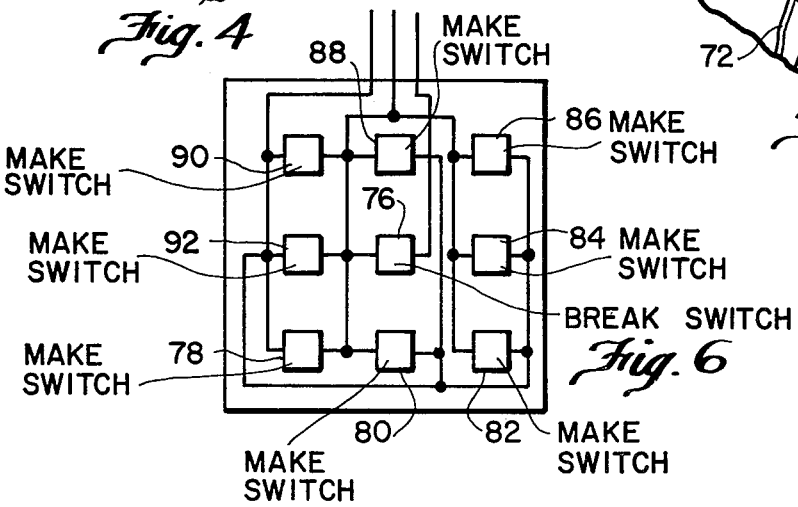
FIG. 6 is an illustration showing an arrangement for switch means for the sentinel current admitting device.

Switch 20 is a reed proximity switch consisting of an element 68 having lead wires 70 and 72 which are identified on the drawing of FIG. 1 by similar numerals and a permanent magnet 74. The switch housing 68 which contains the switch 20 is mounted between the front and back face of the door at the upper edge thereof, as illustrated in FIGS. 2 and 5. The bar magnet portion thereof 74 is mounted in a recess in the door jam, as illustrated in FIG. 2 so that when the door is closed, the magnet in the element 74 operates on the switch 20 in the housing 68 to move the switch to the normally open position illustrated in FIG. 1 of the drawings. When the door is opened, the switch 20 is carried out of the magnetic field of the permanent magnet 74 and the switch 20 operates to the closed position which is opposite to that shown in FIG. 1 to connect the gate of the silicon controlled rectifier 12 to the voltage source and permit operation of the alarm as will be explained.

In use, the physical components of the alarm are mounted on a door, as illustrated in FIG. 2 and as explained above. The wiring to connect the elements is contained in the cavity between the panels of the door as is the 20 volt battery source 21. The double pole double throw switch is operated by the lever 66 on the alarm box 64 to move the switch to dispose the contacts 50 and 52 thereof as indicated in the drawing of FIG. 1. The bar magnet 74 for the switch 20 which is encased within housing 68 is in close proximity to the switch 20 and switch 20 assumes the position illustrated in FIG. 1. The switches 14, 16 and 18 assume the positions illustrated in FIG. 1.

It is desired to render the alarm sensitive to unauthorized opening of the door and this is done by rendering silicon controlled rectifier 10 conductive whereby to cause a current to flow from the voltage source 21 through switch 14 through the flow device 10 and through the circuit consisting of resistors 26 and 28 and condenser 30 to ground. As indicated, this current is a very small current and constitutes only a slight drain on the battery source 21. To establish the current, a person knowing of the location of installation of the unit 51 draws a bar magnet over the surface of the door to bring it into close proximity to either of the switches 16 and 18. The field of the magnet will close either of these switches and apply voltage to the gate 11 of flow control device 10. The application of the voltage to the gate 11 of the flow control device 10 causes it to be conductive. Upon removal of the magnet from proximity of the switches 16 and/or 18, they return to their normal position illustrated in FIG. 1 but the flow of current, once commenced, continues through the flow device 10 notwithstanding removal of the current initiating potential to the gate 11 of the flow control device 10.

The current flow, thus initiated, continues through switch 14 and establishes a potential on the input of flow control device 12 which is also a silicon controlled rectifier. Under these conditions, however, the flow control device 12 will not conduct electricity because there has been no initiating potential applied to its gate 13. If, however, the door is opened by an unauthorized person, the magnet 74 that is maintaining switch 20 in the normal open position, as illustrated in FIG. 1, is moved away from the switch 20 and loses control thereof so that the switch moves to a closed position whereby to apply potential to the gate 13 of the flow control device 12 and initiate current flow therethrough. Current flow through flow control device 12 supplies current to the horn 12 to operate it and sound an alarm. Thus, when the device is rendered operative by manipulation of the double pole double throw switch to locate the contacts 50 and 52 thereof in the position of FIG. 1 and when flow is established through the sentinel flow control device 10 by magnetic manipulation of one of the switches 16 and 18, any subsequent unauthorized opening of the door will sound the alarm 22.

Obviously, it is desired that the alarm not be sounded if the door is opened by an authorized person and the authorized person is in possession of knowledge to render the device inoperative from the outside of the door by terminating flow of current through the sentinel flow control device 10. This is done by applying a bar magnet to the surface of the door so that the bar magnet operates switch 14 to an open position. In this respect, the bar magnet is moved across the door in a predetermined pattern dependent upon the location of the switches so that movement terminates over the switch 14 to move it to an open position. While in the open position, switches 16 and 18 are also open with the result that voltage is removed from sentinel flow control device 10 and the circuit is inoperative.

The magnet that operates switches 14, 16 and 18 must be directly over the switch to operate it and it will not operate more than one switch at one time. Thus, it is necessary to stop movement of the magnet over the break switch 14. If, for example, one were to move the magnet over the break switch 14 and then continue with movement to bring the magnet over a make switch 16 or 18, the sentinel circuit would be energized again. Immediately the magnet left the proximity of the break switch 14, it would resume to its normal closed position and when the magnet arrived at the make switch 16, for example, it would be closed and flow would again be initiated through the sentinel flow control device 10. Thus, the authorized person must have definite knowledge of the precise location of the switch 14 so that he can terminate movement of the magnet at that location. This can be done by appropriate inconspicuous markings on the surface of the door.

Figure 4:
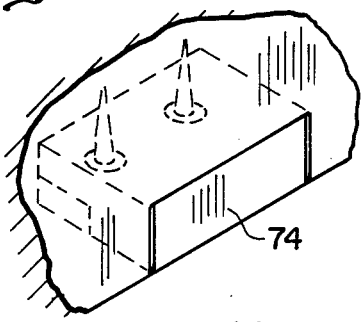
FIG. 4 is a view of the manner in which the magnetic operating member of the switch means for the alarm current flow control device is mounted.

In the circuit diagram of FIG. 1, only two make switches 16 and 18 have been illustrated but, in practice, it is intended to have more than two. The make switches would surround the break switch 14 in all directions so that an unauthorized person moving the magnet over the surface of the door might bring the magnet over the break switch 14 and terminate current flow but, unless he stopped at that location, the termination would only be momentary because as he moved the magnet further, the switch 14 would close and he would come into contact with a make switch to re-establish the current flow. FIG. 4 is a schematic illustration of the physical arrangement of break switch 76 similar to the switch 14 and a series of make switches 78, 80, 82, 84, 86, 88, 90 and 92 connected in parallel similarly to the circuit diagram make switches 16 and 18 of FIG. 1 and located relative to each other so that the break switch is close to and surrounded by make switches. As explained above, an unauthorized person not knowing the location of the break switch but in possession of a magnet would have a difficult time rendering the device inoperative because the tendency would be to stop movement of the magnet at a location other than the location of the break switch 76.

The double pole double throw switch previously referred to is a night switch that permits one to set the device for operation from the inside of the door. By operating the lever 66 on the alarm box 64 the arms 50 and 52 of the switch each assume opposite positions to those shown in FIG. 1. Thus, arm 50 is closed and arm 52 is open. Closure of arm 50 applies sentinel voltage to the gate of silicon controlled rectifier 10 sufficient to cause it to conduct and sound the alarm upon application of a gate voltage through closure of switch 20, which as indicated above occurs on opening of the door. Opening of arm 52 terminates the high resistance sentinel circuit. However, if silicon control device 12 is rendered conducting then silicon control device 10 will also conduct because it has voltage applied to its gate and its anode.

It will be noted that the alarm once started will continue to sound until voltage is removed from the anode of silicon controlled rectifier 10 by opening of break switch 14 as described above.

Changes and modifications to the specific embodiment of the device enclosed will be apparent to those skilled in the art. Flow control devices other than a silicon control rectifier will obviously be apparent to those skilled in the art. Moreover, the form of the alarm could be varied and the arrangements of the circuit could be varied. The form of the component and their mounting as well as the circuit are capable of considerable modification within the scope of the invention. The switch 14 for terminating current supply to the sentinel circuit for example could be a reed switch normally open between line 21 and 52 so that when closed by application of a field it short circuits the sentinel circuit as terminates current flow.

Following are values of components for the device illustrated in the drawings:

| | | |
|---|---|---|
| Resistor 24 | 8000 | ohms |
| Resistor 26 | 1800 | ohms |
| Resistor 28 | 4300 | ohms |
| Condenser 30 | 0.1 | micro-farads |
| Resistor 32 | 1000 | ohms |
| Resistor 34 | 100 | ohms |
| Condenser 36 | .1 | micro-farads |
| Condenser 38 | 0.1 | micro-farads |
| Resistor 40 | 1000 | ohms |
| Resistor 42 | 100 | ohms |
| Condenser 44 | 0.1 | micro-farads |
| Condenser 46 | 0.1 | micro-farads |

-continued

| | | |
|---|---|---|
| Resistor 43 | 12,000 | ohms |

It will be appreciated, then, that the foregoing are specific values for a specific device and that it is not intended that the invention be limited to any specific values.

What I claim as my invention is:

1. In an alarm circuit a sentinel device adapted to provide stand-by voltage to operate an alarm;

said sentinel device being normally inoperative when an operating voltage is applied thereto;

enabling means including a plurality of switches operable by the application of an energy field to render said sentinel device operative whereby to provide stand-by voltage for an alarm;

first switch means operable by application of an energy field for rendering said sentinel device inoperative;

second switch means operable on the opening of a door or the like to cause stand-by voltage of said sentinel device to operate said alarm when said sentinel device is rendered operative by said switches of said enabling means;

said first switch means and said plurality of switches of said enabling means being in close proximity to each other.

2. In an alarm circuit the elements claimed in claim 1 wherein said first switch means is surrounded by said plurality of switches of said enabling means.

3. In an alarm circuit the elements claimed in claim 2 wherein said energy field is a magnetic field.

4. An alarm adapted to sense as claimed in claim 3 in which said switches of said enabling means and said first switch means comprise reed switches.

5. An alarm adapted to sense as claimed in claim 3 in which said switch of said enabling means and said first switch means comprise reed switches.

6. An alarm adapted to sense as claimed in claim 2 in which said switches of said enabling means and said first switch means comprise reed switches.

7. In an alarm circuit the elements claimed in claim 1 wherein said energy field is a magnetic field.

8. An alarm adapted to sense as claimed in claim 7 in which said switches of said enabling means and said first switch means comprise reed switches.

9. An alarm adapted to sense as claimed in claim 1 in which said switches of said enabling means and said first switch means comprise reed switches.

* * * * *